US010837462B2

(12) United States Patent
Kawai et al.

(10) Patent No.: US 10,837,462 B2
(45) Date of Patent: Nov. 17, 2020

(54) VOLUTE PUMP

(71) Applicant: Ebara Corporation, Tokyo (JP)

(72) Inventors: Masahito Kawai, Tokyo (JP); Hiromi Sakacho, Tokyo (JP); Masashi Obuchi, Tokyo (JP); Hiroshi Uchida, Tokyo (JP); Miho Isono, Tokyo (JP); Kenta Tokairin, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 2 days.

(21) Appl. No.: 15/560,909

(22) PCT Filed: Mar. 24, 2016

(86) PCT No.: PCT/JP2016/059380

§ 371 (c)(1),
(2) Date: Sep. 22, 2017

(87) PCT Pub. No.: WO2016/158667

PCT Pub. Date: Oct. 6, 2016

(65) Prior Publication Data

US 2018/0051718 A1 Feb. 22, 2018

(30) Foreign Application Priority Data

Mar. 27, 2015 (JP) ..... 2015-067141

(51) Int. Cl.
*B63H 1/16* (2006.01)
*F04D 29/70* (2006.01)
(Continued)

(52) U.S. Cl.
CPC ..... *F04D 29/708* (2013.01); *F04D 7/04* (2013.01); *F04D 7/045* (2013.01); *F04D 29/245* (2013.01);
(Continued)

(58) Field of Classification Search
CPC ..... F04D 29/708; F04D 7/04; F04D 29/245; F04D 29/70
(Continued)

(56) References Cited

U.S. PATENT DOCUMENTS 1,182,439 A * 5/1916 Wood ..... F04D 29/225 415/203
1,754,992 A * 4/1930 Fabrin ..... F04D 29/225 415/198.1
(Continued)

FOREIGN PATENT DOCUMENTS

CN 101198793 A 6/2008
CN 202946441 U 5/2013
(Continued)

OTHER PUBLICATIONS

Chinese Office action issued in Patent Application No. CN-201680017550.1 dated Sep. 17, 2018.
(Continued)

*Primary Examiner* — Hung Q Nguyen
*Assistant Examiner* — Anthony Donald Taylor, Jr.
(74) *Attorney, Agent, or Firm* — Pearne & Gordon LLP

(57) ABSTRACT

A volute pump for delivering a liquid containing fibrous substances. The volute pump includes an impeller (1) rotatable together with a rotational shaft (11), and an impeller casing (5) having a suction port (3) and a volute chamber (7). A groove (18), extending from the suction port (3) to the volute chamber (7), is formed in an inner surface of the impeller casing (5). The impeller (1) includes a hub (13) to which the rotational shaft (11) is fixed, and a sweep-back vane (2) extending helically from the hub (13). The sweep-back vane (2) includes a leading edge portion (2*a*) extending helically from the hub (13), and a trailing edge portion (2*b*) extending helically from the leading edge portion (2*a*). The
(Continued)

leading edge portion (2*a*) has a front-side curved surface (2*e*) extending from an inner end (2*c*) to an outer end (2*d*) of the leading edge portion (2*a*).

5 Claims, 14 Drawing Sheets

(51) Int. Cl.
*F04D 7/04* (2006.01)
*F04D 29/24* (2006.01)
*F04D 29/22* (2006.01)
*F04D 29/42* (2006.01)

(52) U.S. Cl.
CPC ..... *F04D 29/2288* (2013.01); *F04D 29/4273* (2013.01); *F05D 2240/303* (2013.01); *F05D 2250/71* (2013.01)

(58) Field of Classification Search
USPC ..... 416/179
See application file for complete search history.

(56) References Cited

U.S. PATENT DOCUMENTS 1,763,595 A * 6/1930 Paatsch ..... F04D 29/225 415/196
2,236,706 A * 4/1941 Damonte ..... F04D 7/04 415/196
3,447,475 A * 6/1969 Blum ..... F04D 7/045 415/121.1
4,681,508 A * 7/1987 Kim ..... F04D 29/2238 415/116
5,692,880 A * 12/1997 Zelder ..... F04D 29/225 416/175
6,139,260 A * 10/2000 Arbeus ..... F04D 7/04 415/121.2
6,158,959 A * 12/2000 Arbeus ..... F04D 7/04 415/204
6,390,768 B1 * 5/2002 Muhs ..... F04D 7/045 415/196
6,464,454 B1 * 10/2002 Kotkaniemi ..... F04D 7/045 415/121.1
8,025,479 B2 * 9/2011 Scott ..... F04D 7/04 415/206
9,556,739 B2 * 1/2017 Springer ..... F04D 29/2294
9,869,326 B2 * 1/2018 Stark ..... F04D 7/04
2005/0095124 A1 * 5/2005 Arnold ..... F04D 7/045 415/174.4
2012/0282085 A1 * 11/2012 Bajeet ..... F04D 29/2288 415/196
2013/0108411 A1 * 5/2013 Ciotola ..... B02C 18/0092 415/1
2014/0079558 A1 * 3/2014 Koivikko ..... F04D 29/24 416/223 R
2015/0240818 A1 * 8/2015 Haddad ..... F04D 7/04 415/206

FOREIGN PATENT DOCUMENTS

GB 408159 * 4/1934 ..... F04D 29/2288
GB 408159 A 4/1934
JP S64-11390 U 1/1989
JP H03-96698 A 4/1991
JP H11-201087 A 7/1999
WO 2005-100796 A1 10/2005
WO 2014-029790 A1 2/2014
WO 2015000677 A1 1/2015

OTHER PUBLICATIONS

Written Opinion issued in Patent Application No. PCT/JP2016/059380 dated Jun. 21, 2016.
International Search Report issued in Patent Application No. PCT/JP2016/059380 dated Jun. 21, 2016.
Extended European Search Report issued in European Patent Application No. EP 16 77 2548 dated Oct. 17, 2018.

* cited by examiner (a)

(b)

(c)

VOLUTE PUMP

TECHNICAL FIELD

The present invention relates to a volute pump, and more particularly to a volute pump for delivering a liquid containing fibrous substances.

BACKGROUND ART

Conventionally, a volute pump has been used for delivering a liquid, such as sewage water flowing through a sewage pipe. Such sewage water may contain fibrous substances, such as string, or textile. When the fibrous substances are accumulated on a vane of an impeller, the pump may be clogged. Therefore, in order to prevent the fibrous substances from being accumulated on the impeller, there is a volute pump which includes an impeller having sweep-back vane (see Patent document 1).

FIG. 17 is a cross-sectional view showing a volute pump which includes an impeller having sweep-back vanes. As shown in FIG. 17, an impeller 100 includes a plurality of sweep-back vanes 101. The impeller 100 is fixed to a rotational shaft 102, and is housed within an impeller casing 105. The impeller 100 is rotated in a direction of a solid-line arrow, shown in FIG. 17, together with the rotational shaft 102 by an actuator (e.g., electric motor), which is not illustrated. A liquid is discharged in a circumferential direction into a volute chamber 113, which is formed in the impeller casing 105, by the rotation of the impeller 100. The liquid flowing in the volute chamber 113 is discharged through a discharge port 107 to an outside.

The sweep-back vane 101 has a leading edge portion 101*a* which extends helically, and a trailing edge portion 101*b* which extends helically from the leading edge portion 101*a*. The sweep-back vane 101 has a helical shape in which the leading edge portion 101*a* extends from its base-end in a direction opposite to the rotating direction of the impeller 100.

The impeller casing 105 is provided with a tongue portion 110 which forms a starting portion of the volute chamber 113. The liquid flowing in the volute chamber 113 is divided by the tongue portion 110, so that most of the liquid flows toward the discharge port 107 and a part of the liquid circulates in the volute chamber 113 (see a dotted line arrow shown in FIG. 17).

FIG. 18 is a view showing the impeller casing 105, which houses the impeller 100 therein, as viewed from a suction port 106, and FIG. 19 is a view showing an inner surface of the impeller casing 105 as viewed from the actuator. In FIG. 19, depiction of the impeller 100 is omitted. As shown in FIG. 18 and FIG. 19, a groove 108, extending helically from the suction port 106 to the volute chamber 113, is formed in the inner surface of the impeller casing 105. This groove 108 is provided for transferring the fibrous substance, which is contained in the liquid, from the suction port 106 to the volute chamber 113 by means of the rotating impeller 100.

CITATION LIST

Patent Literature

Patent document 1: Japanese laid-open utility model publication No. 64-11390

SUMMARY OF INVENTION

Technical Problem

FIGS. 20 through 24 are views each showing a state in which the fibrous substance 109 is transferred to the volute chamber 113 through the groove 18. In FIGS. 20 through 24, the groove 108 is illustrated by a two-dot chain line. As shown in FIG. 20, the fibrous substance 109 contained in the liquid is transferred to an inlet of the groove 108, and is pushed into the groove 108 by the leading edge portion 101*a* of the rotating impeller 100. The fibrous substance 109 is pushed by the trailing edge portion 101*b* of the rotating impeller 100 while being sandwiched between the groove 108 and the trailing edge portion 101*b* of the impeller 100, thereby moving along the groove 108 (see FIGS. 21 through 23). Then, as shown in FIG. 24, the fibrous substance 109 is released into the volute chamber 113.

As described above, the fibrous substance 109 is pushed into the groove 108 by the sweep-back vane 101 of the rotating impeller 100, and is then transferred to the volute chamber 113 along the groove 108 as shown in FIGS. 20 through 24. However, the fibrous substance 109 may be caught by the leading edge portion 101*a* of the sweep-back vane 101, and thus the fibrous substance 109 may not be able to be transferred to the inlet of the groove 108. When following fibrous substances are also caught by the leading edge portion 101*a*, the fibrous substances are accumulated on the impeller 100, thereby inhibiting the rotation of the impeller 100.

The present invention has been made in view of the above circumstance. It is therefore an object of the present invention to provide a volute pump capable of smoothly guiding a fibrous substance, which is contained in a liquid, to a groove formed in an inner surface of an impeller casing, and reliably pushing the fibrous substance into the groove to discharge it from a discharge port.

Solution to Problem

In order to achieve the object, according to one aspect of the present invention, there is provided a volute pump comprising: an impeller rotatable together with a rotational shaft; and an impeller casing having a suction port and a volute chamber; wherein a groove, extending from the suction port to the volute chamber, is formed in an inner surface of the impeller casing, the impeller includes a hub to which the rotational shaft is fixed, and a sweep-back vane extending helically from the hub, the sweep-back vane includes a leading edge portion extending helically from the hub, and a trailing edge portion extending helically from the leading edge portion, and the leading edge portion has a front-side curved surface extending from an inner end to an outer end of the leading edge portion.

In a preferred aspect of the present invention, a ratio of a radius of curvature of the front-side curved surface to a thickness of the leading edge portion is in a range of 1/7 to 1/2.

In a preferred aspect of the present invention, the ratio of the radius of curvature of the front-side curved surface to the thickness of the leading edge portion is in a range of 1/4 to 1/2.

In a preferred aspect of the present invention, the ratio of the radius of curvature of the front-side curved surface to the thickness of the leading edge portion gradually increases according to a distance from the hub.

In a preferred aspect of the present invention, the leading edge portion has a back-side curved surface extending from the inner end to the outer end of the leading edge portion.

In a preferred aspect of the present invention, the trailing edge portion has a front-side angular portion and a back-side angular portion extending from a starting end to a terminal end of the trailing edge portion connected with the outer end of the leading edge portion.

Advantageous Effects of Invention

According to the present invention, the fibrous substance can smoothly slide on the leading edge portion without being caught by the leading edge portion, and can be transferred to an inlet of the groove, because the leading edge portion of the sweep-back vane has the front-side curved surface. Further, the fibrous substance is pushed into the groove by the front-side curved surface. Therefore, the fibrous substance is transferred to the volute chamber along the groove by the rotation of the impeller, and is then discharged from the discharge port.

BRIEF DESCRIPTION OF DRAWINGS

FIG. 10(*b*) is a schematic view showing a state in which the fibrous substance is smoothly transferred toward an outer end of the leading edge portion as the sweep-back vane rotates;

FIG. 10(*c*) is a schematic view showing a state in which the fibrous substance reaches the outer end of the leading edge portion as the sweep-back vane rotates;

DESCRIPTION OF EMBODIMENTS

Figure 1:
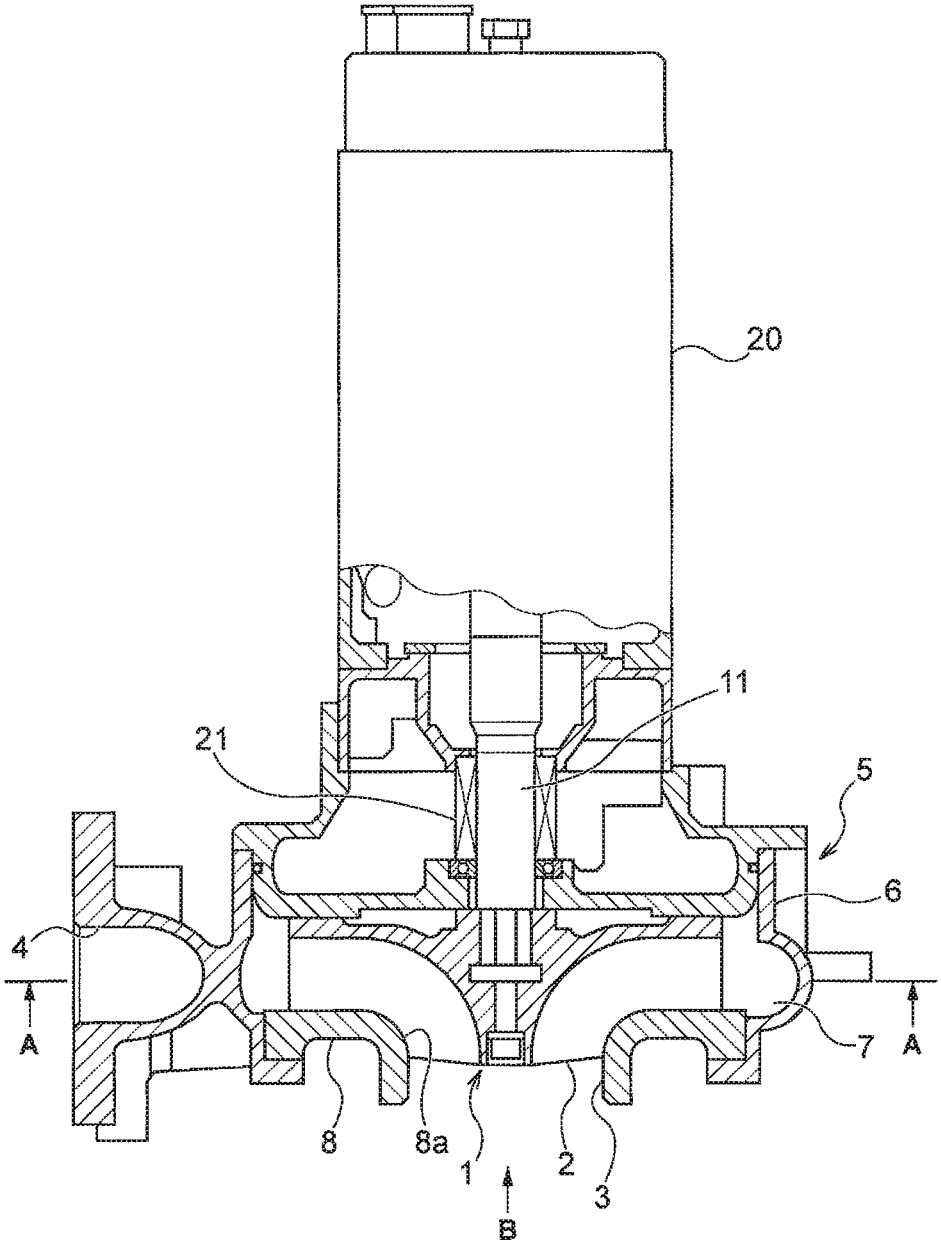
FIG. 1 is a schematic cross-sectional view of a volute pump according to an embodiment of the present invention.

Embodiments of the present invention will be described below with reference to the drawings. The same reference numerals are used in FIGS. 1 through 16 to refer to the same or corresponding elements, and duplicate descriptions thereof will be omitted.

FIG. 1 is a schematic cross-sectional view of a volute pump according to an embodiment of the present invention. The volute pump shown in FIG. 1 is, for example, used for delivering a liquid, such as sewage water flowing through a sewage pipe. As shown in FIG. 1, the volute pump includes an impeller 1 which is fixed to an end of a rotational shaft 11, and an impeller casing 5 which houses the impeller 1 therein. The rotational shaft 11 is rotated by a motor 20, and the impeller 1 is rotated in the impeller casing 5 together with the rotational shaft 11. A mechanical seal 21 is disposed between the motor 20 and the impeller 1. This mechanical seal 21 prevents the liquid from entering the motor 20.

The impeller casing 5 includes a casing body 6 disposed around the impeller 1, and a casing liner 8 coupled to the casing body 6. The casing liner 8 has a cylindrical suction port 3 formed therein. A volute chamber (vortex chamber) 7 is formed inside the casing body 6, and the volute chamber 7 is shaped so as to surround the impeller 1. The casing body 6 has a discharge port 4 formed therein.

When the impeller 1 is rotated, the liquid is sucked from the suction port 3. The rotation of the impeller 1 gives a velocity energy to the liquid, and the velocity energy is converted into a pressure energy when the liquid is flowing through the volute chamber 7, so that the liquid is pressurized. The pressurized liquid is discharged through the discharge port 4. Vanes (sweep-back vanes) 2 of the impeller 1 face an inner surface 8*a* of the casing liner 8 of the impeller casing 5 with a small gap. In an example, this gap is in a range of 0.3 mm to 0.7 mm.

Figure 2:
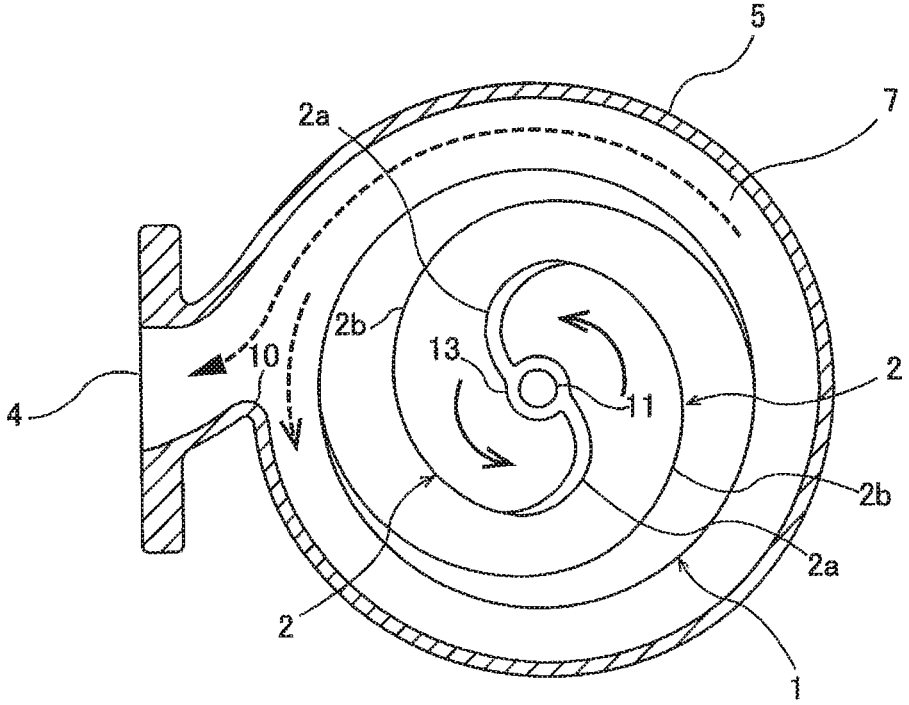
FIG. 2 is a cross-sectional view taken along line A-A in FIG. 1.

FIG. 2 is a cross-sectional view taken along line A-A in FIG. 1. As shown in FIG. 2, the impeller 1 includes a plurality of (two in this embodiment) sweep-back vanes 2, and a cylindrical hub 13. The impeller 1 is fixed to the rotational shaft 11, and is rotated together with the rotational shaft 11 in a direction indicated by a solid line arrow by the motor (actuator) 20. An end of the rotational shaft 11 is inserted into the hub 13, and the impeller 1 is fixed to the end of the rotational shaft 11 by fastening tool (not shown).

The sweep-back vane 2 has a leading edge portion 2*a* which extends helically from the hub 13, and a trailing edge portion 2*b* which extends helically from the leading edge portion 2*a*. The sweep-back vane 2 has a helical shape extending from its base-end in a direction opposite to the rotating direction of the impeller 1.

As shown in FIG. 2, the impeller casing 5 is provided with a tongue portion 10 which forms a starting portion of the volute chamber 7. The volute chamber 7 has a shape such that the volute chamber 7 extends along a circumferential direction of the impeller 1 while a cross-sectional area of the volute chamber 7 increases gradually. The liquid flowing in the volute chamber 7 is divided by the tongue portion 10, so that most of the liquid flows toward the discharge port 4 and a part of the liquid circulates through the volute chamber 7 (see a dotted line arrow shown in FIG. 2).

Figure 3:
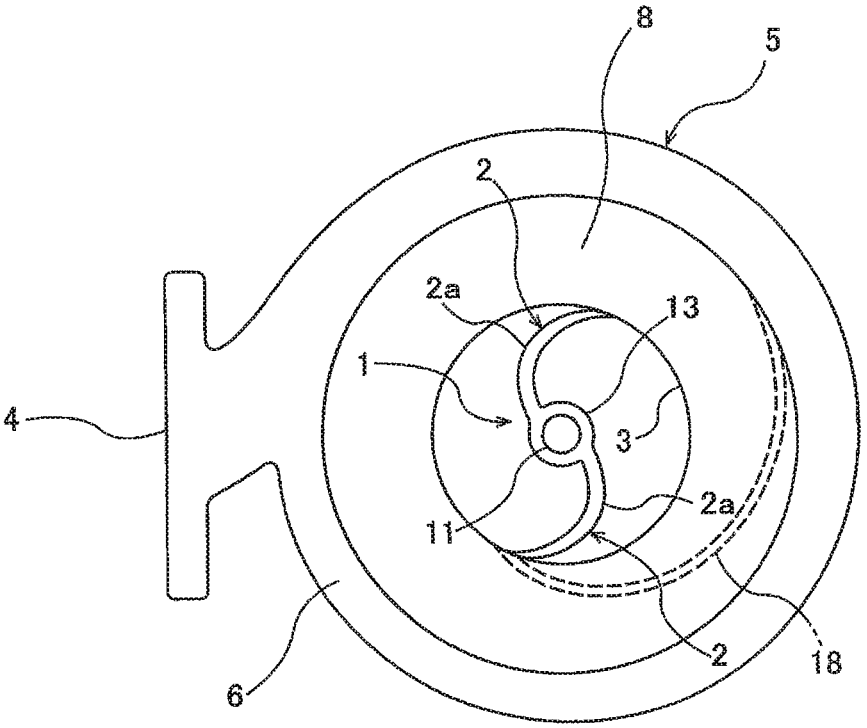
FIG. 3 is a view from a direction indicated by arrow B shown in FIG. 1.

FIG. 3 is a view from a direction indicated by arrow B shown in FIG. 1. As shown in FIG. 3, the impeller casing 5 has the suction port 3 and the discharge port 4 formed therein. The suction port 3 and the discharge port 4 communicate with the volute chamber 7. The suction port 3 is formed in the casing liner 8, and the discharge port 4 is formed in the casing body 6. The liquid which has flowed in from the suction port 3 is discharged to the volute chamber 7 in its circumferential direction by the rotation of the impeller 1. The liquid flowing through the volute chamber 7 is discharged through the discharge port 4 to an outside.

Figure 4:
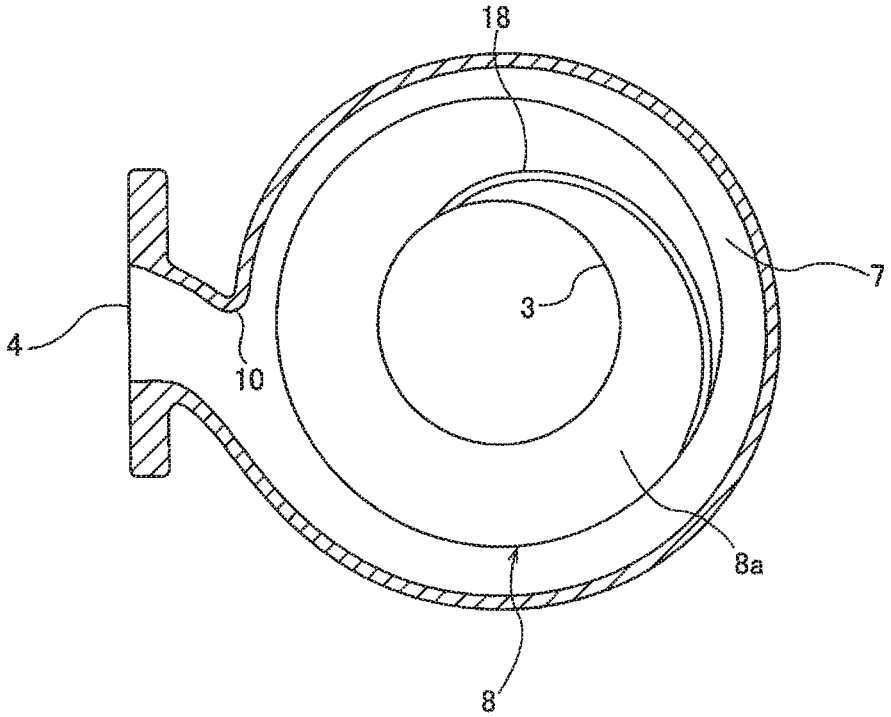
FIG. 4 is a view showing an inner surface of an impeller casing as viewed from a motor-side.
Figure 5:
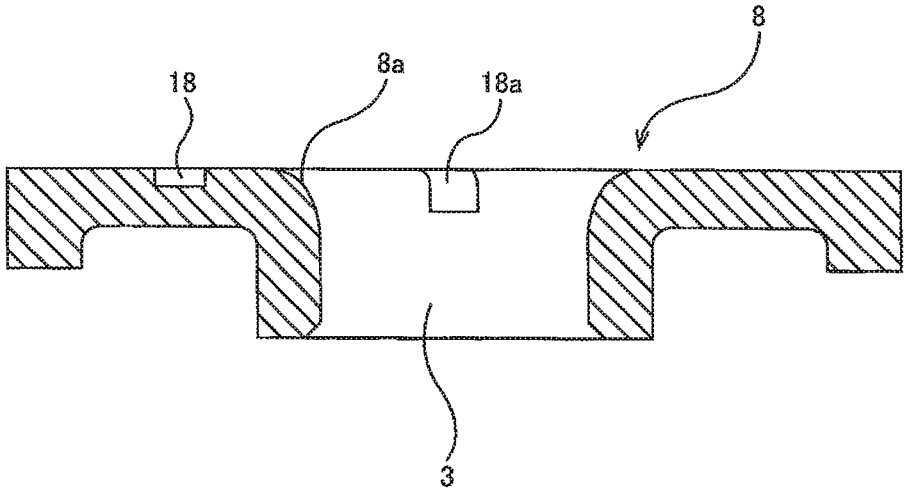
FIG. 5 is a cross-sectional view of a casing liner of the volute pump shown in FIG. 1.

FIG. 4 is a view showing an inner surface of the impeller casing 5 as viewed from a side of the motor 20, and FIG. 5 is a cross-sectional view of the casing liner 8 shown in FIG. 1. In FIG. 4, depiction of the impeller 1 is omitted. As shown in FIG. 4 and FIG. 5, a groove 18 extending helically from the suction port 3 to the volute chamber 7 is formed in the inner surface of the impeller casing 5, more specifically in the inner surface 8*a* of the casing liner 8. This groove 18 is provided for transferring a fibrous substance, which is contained in the liquid, from the suction port 3 to the volute chamber 7 by means of the rotating impeller 1. The groove 18 is located so as to face the trailing edge portion 2*b* of the sweep-back vane 2.

The groove 18 has an inlet 18*a* connected to the suction port 3. The groove 18 extends to an outer circumferential edge of the casing liner 8. Since this outer circumferential edge of the casing liner 8 is located in the volute chamber 7, the groove 18 extends from the suction port 3 to the volute chamber 7.

Figure 6:
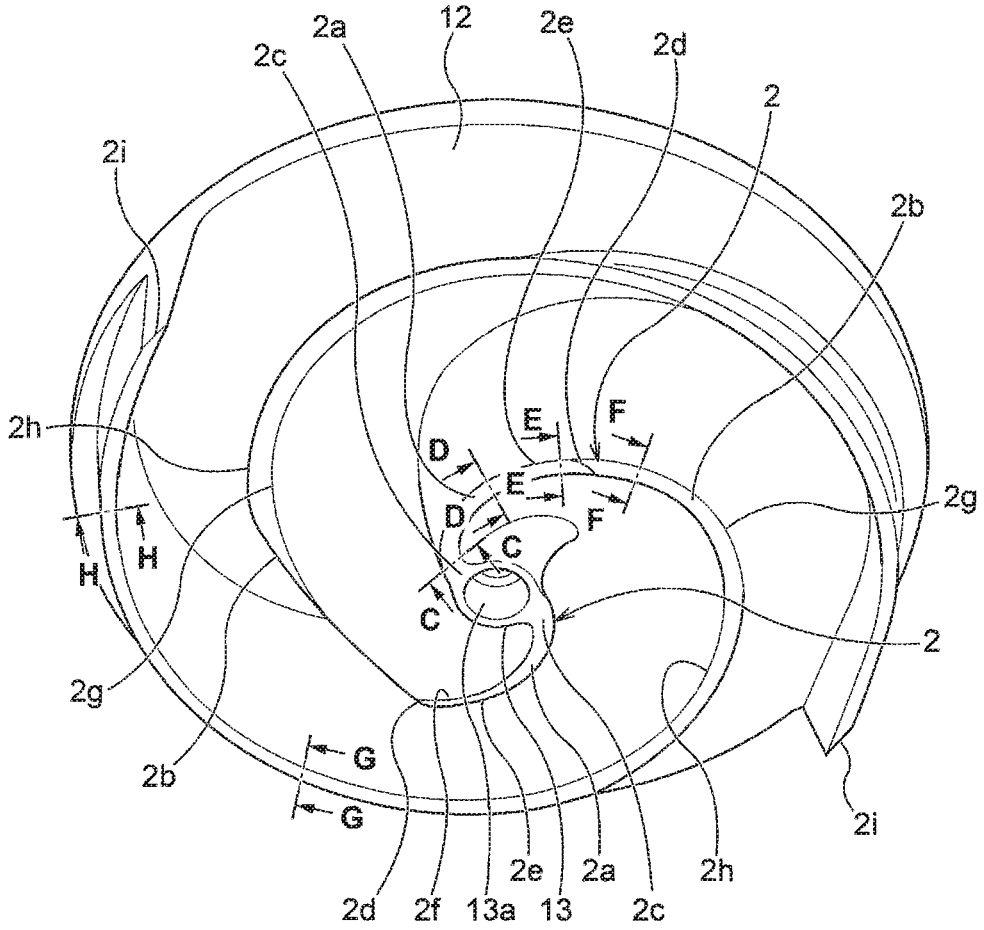
FIG. 6 is a perspective view of an impeller of the volute pump shown in FIG. 1.

FIG. 6 is a perspective view of the impeller 1 of the volute pump shown in FIG. 1. As shown in FIG. 6, the impeller 1 includes a disk-shaped shroud 12 having the hub 13 to which the rotational shaft 11 is fixed, and the sweep-back vanes 2 which extend helically from the hub 13. The hub 13 has a through-hole 13*a* formed therein, into which the end of the rotational shaft 11 is inserted. The entirety of the sweep-back vane 2 has a helical shape which extends from the hub 13 in the direction opposite to the rotating direction of the impeller 1.

The sweep-back vane 2 has the leading edge portion 2*a* extending helically from the hub 13, and the trailing edge portion 2*b* extending helically from the leading edge portion 2*a*. The leading edge portion 2*a* extends from the hub 13 in the direction opposite to the rotating direction of the impeller 1. Therefore, an outer end 2*d* of the leading edge portion 2*a* is located behind an inner end 2*c* of the leading edge portion 2*a* in the rotating direction of the rotational shaft 11. The trailing edge portion 2*b* faces the inner surface 8*a* of the casing liner 8 with the small gap. When the impeller 1 is rotated, the outer end 2*d* of the leading edge portion 2*a* moves across the inlet 18*a* (see FIG. 5) of the groove 18.

Figure 7:
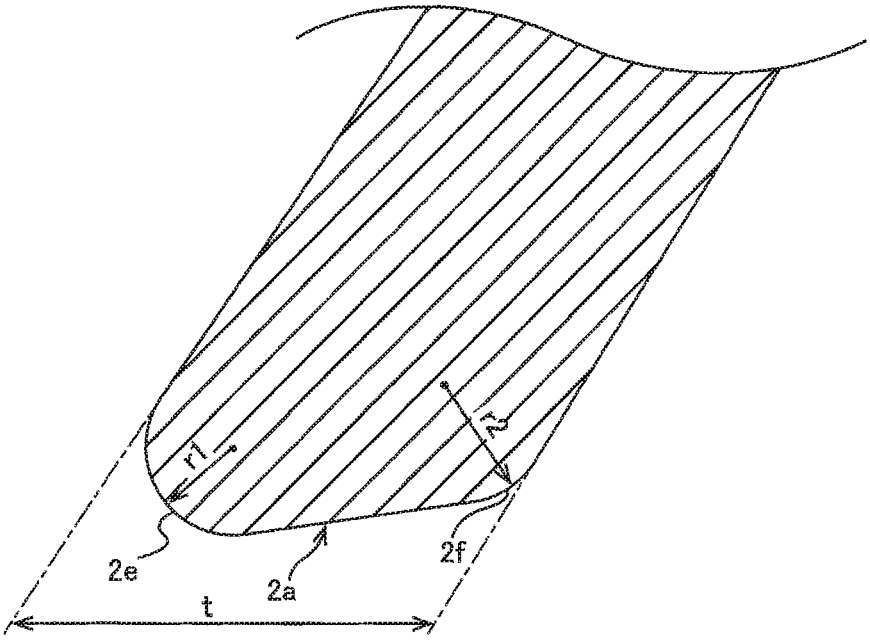
FIG. 7 is a cross-sectional view of a leading edge portion of a sweep-back vane taken along C-C line in FIG. 6.
Figure 8:
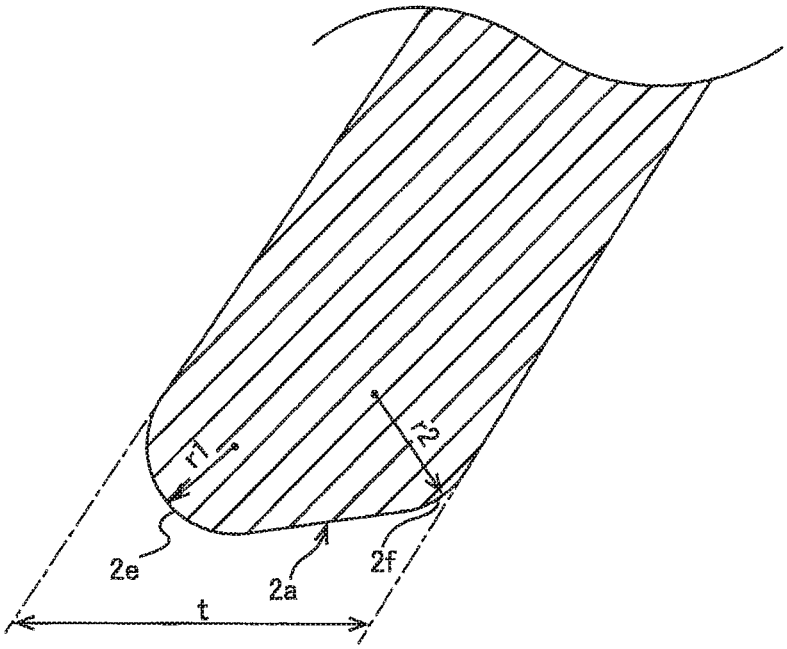
FIG. 8 is a cross-sectional view of the leading edge portion of the sweep-back vane taken along line D-D in FIG. 6.
Figure 9:
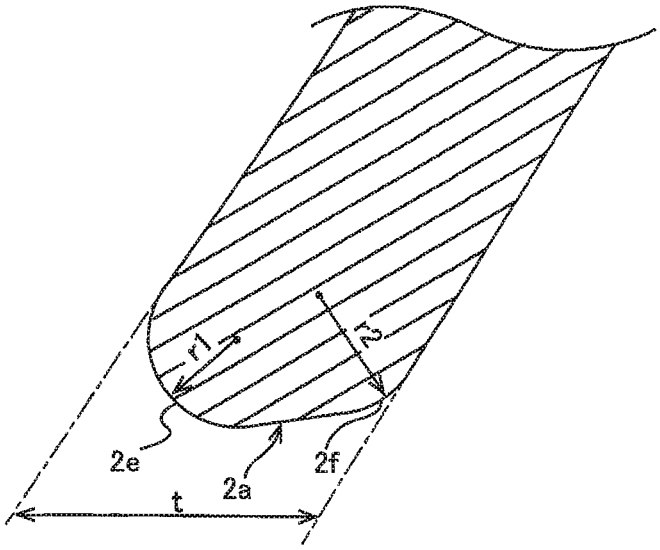
FIG. 9 is a cross-sectional view of the leading edge portion of the sweep-back vane taken along line E-E in FIG. 6.

FIG. 7 is a cross-sectional view of the leading edge portion 2*a* of the sweep-back vane 2 taken along line C-C in FIG. 6. FIG. 8 is a cross-sectional view of the leading edge portion 2*a* of the sweep-back vane 2 taken along line D-D in FIG. 6. FIG. 9 is a cross-sectional view of the leading edge portion 2*a* of the sweep-back vane 2 taken long line E-E in FIG. 6. As shown in FIG. 7, FIG. 8, and FIG. 9, the leading edge portion 2*a* has a front-side curved surface 2*e* extending from the inner end 2*c* to the outer end 2*d* of the leading edge portion 2*a*. The front-side curved surface 2*e* is a forefront of the leading edge portion 2*a*. Specifically, the front-side curved surface 2*e* is a surface of the leading edge portion 2*a* which is located at the foremost position in a rotating direction of the leading edge portion 2*a* (i.e., the rotating direction of the impeller 1), and extends from the inner end 2*c* to the outer end 2*d* of the leading edge portion 2*a*.

A cross-section of the front-side curved surface 2*e* has an arc shape with a radius of curvature r1. In this embodiment, as shown in FIG. 7, FIG. 8, and FIG. 9, the radius of curvature r1 is constant from the inner end 2*c* to the outer end 2*d* of the leading edge portion 2*a*. The radius of curvature r1 of the front-side curved surface 2*e* may vary from the inner end 2*c* to the outer end 2*d* of the leading edge portion 2*a*. For example, the radius of curvature r1 of the front-side curved surface 2*e* may increase or decrease gradually according to a distance from the hub 13.

Figure 10:
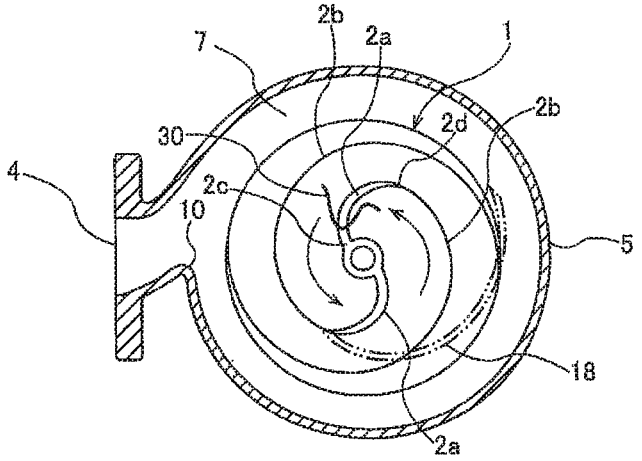
FIG. 10(*a*) is a schematic view showing a state in which a fibrous substance is placed on the leading edge portion of the sweep-back vane.
Figure 10:
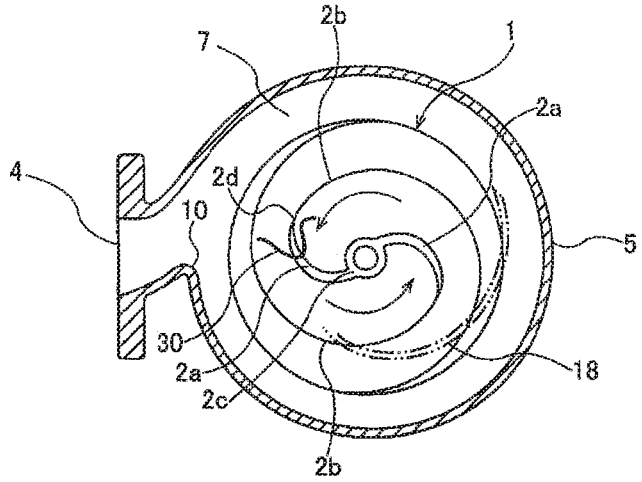
Figure 10:
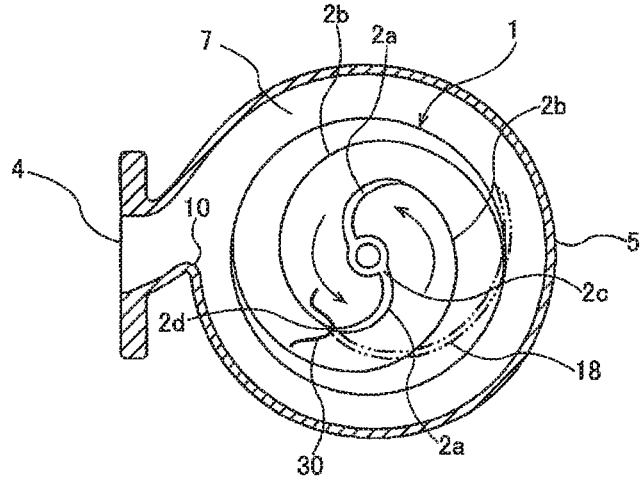

Since the leading edge portion 2*a* has the front-side curved surface 2*e* extending from the inner end 2*c* to the outer end 2*d* thereof, a fibrous substance 30 that is placed on the leading edge portion 2*a* as shown in FIG. 10(*a*) is smoothly transferred toward the outer end 2*d* of the leading edge portion 2*a* without being caught by the leading edge portion 2*a* as shown in FIG. 10(*b*), and then reaches the outer end 2*d* of the leading edge portion 2*a* as shown in FIG. 10(*c*). Therefore, the leading edge portion 2*a* can smoothly guide the fibrous substance 30 to the inlet 18*a* (see FIG. 5) of the groove 18.

Figure 11:
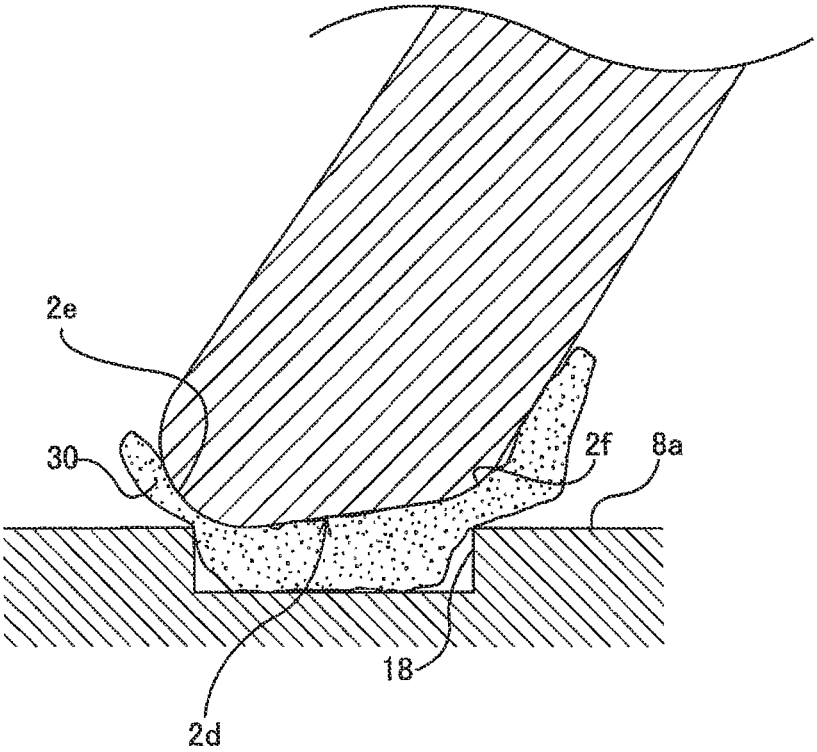
FIG. 11 is a schematic view showing a state in which the fibrous substance that has been guided to the outer end of the leading edge portion is pushed into a groove, formed in the inner surface of the casing liner, by a front-side curved surface of the leading edge portion.

FIG. 11 is a schematic view showing a state in which the fibrous substance 30 guided to the outer end 2*d* of the leading edge portion 2*a* is pushed into the groove 18 by the front-side curved surface 2*e*. As described above, when the impeller 1 is rotated, the outer end 2*d* of the leading edge portion 2*a* of the sweep-back vane 2 passes over the groove 18 (see FIG. 5 and FIG. 4) formed in the inner surface 8*a* of the casing liner 8. As shown in FIG. 11, the fibrous substance 30 guided to the outer end 2*d* is pushed into the groove 18 by the front-side curved surface 2*e*, when the outer end 2*d* passes over the groove 18. Since the front-side curved surface 2*e* extends to the outer end 2*d* of the leading edge portion 2*a*, the fibrous substance 30 is pushed into the groove 18 by the front-side curved surface 2*e* without being caught by the outer end 2*d* of the leading edge portion 2*a*. As a result, the fibrous substance 30 can be reliably transferred into the groove 18.

As shown in FIG. 7, FIG. 8, and FIG. 9, the leading edge portion 2*a* may have a back-side curved surface 2*f* extending from the inner end 2*c* to the outer end 2*d* of the leading edge portion 2*a*. The back-side curved surface 2*f* is a rearmost surface of the leading edge portion 2*a*. Specifically, the back-side curved surface 2*f* is a surface of the leading edge portion 2*a* which is located at the rearmost position in the rotating direction of the leading edge portion 2*a* (i.e., the rotating direction of the impeller 1), and is located behind the front-side curved surface 2*e* in the rotating direction of the impeller 1. As with the front-side curved surface 2*e*, the back-side curved surface 2*f* extends from the inner end 2*c* to the outer end 2*d* of the leading edge portion 2*a*.

A cross-section of the back-side curved surface 2*f* has an arc shape with a radius of curvature r2. In this embodiment, as shown in FIG. 7, FIG. 8, and FIG. 9, the radius of curvature r2 is constant from the inner end 2*c* to the outer end 2*d* of the leading edge portion 2*a*. The radius of curvature r2 of the back-side curved surface 2*f* may be the same as or different from the radius of curvature r1 of the front-side curved surface 2*e*. Further, the radius of curvature r2 of the back-side curved surface 2*f* may vary from the inner end 2*c* to the outer end 2*d* of the leading edge portion 2*a*. For example, the radius of curvature r2 of the back-side curved surface 2*f* may increase or decrease gradually according to a distance from the hub 13.

In a case where the leading edge portion 2*a* has not only the front-side curved surface 2*e* but also the back-side curved surface 2*f*, the fibrous substance 30 can more smoothly slide on the leading edge portion 2*a*. As a result, the leading edge portion 2*a* can smoothly guide the fibrous substance 30 to the outer end 2*d* of the leading edge portion 2*a*. Further, fibrous substance 30 is hardly caught by the outer end 2*d* of the leading edge portion 2*a*. As a result, the front-side curved surface 2*e* of the leading edge portion 2*a* can more reliably push the fibrous substance 30 into the inlet 18*a* (see FIG. 5) of the groove 18.

As described above, the fibrous substance 30 slides on the front-side curved surface 2*e* toward the outer end 2*d* of the leading edge portion 2*a*, as the impeller 1 rotates. As a ratio (i.e., r1/t) of the radius of curvature r1 of the front-side curved surface 2*e* to a thickness t (see FIG. 7, FIG. 8, and FIG. 9) of the leading edge portion 2*a* becomes smaller, the leading edge portion 2*a* becomes sharper. It has been confirmed that, when r1/t is equal to or more than 1/7, the fibrous substance 30 placed on the leading edge portion 2*a* can be more smoothly guided toward the outer end 2*d* of the leading edge portion 2*a*, and can be more reliably pushed into the groove 18. Therefore, r1/t is preferably equal to or more than 1/7.

As r1/t becomes larger, a discharging performance of the volute pump decreases. The optimal value of r1/t for smoothly sliding the fibrous substance 30 toward the outer end 2*d* of the leading edge portion 2*a* while suppressing the decrease in the discharging performance of the volute pump is 1/4. Therefore, r1/t is more preferably equal to or more than 1/4.

Figure 12:
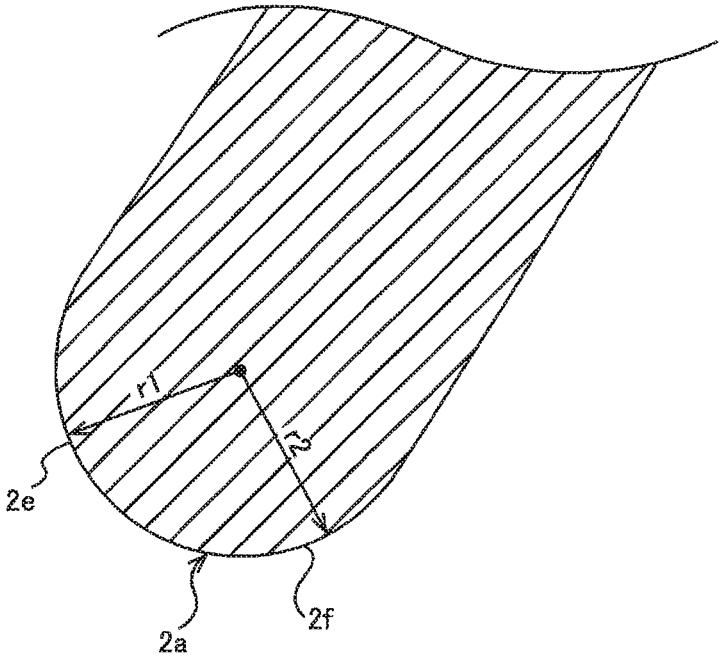
FIG. 12 is a cross-sectional view of the leading edge portion in which a ratio of a radius of curvature of the front-side curved surface to a thickness of the leading edge portion, and a ratio of a radius of curvature of a back-side curved surface to the thickness of the leading edge portion are ½, and the front-side curved surface is connected with the back-side curved surface.

FIG. 12 is a cross-sectional view of the leading edge portion 2*a* in which the ratio (i.e., r1/t) of the radius of curvature r1 of the front-side curved surface 2*e* to the thickness t of the leading edge portion 2*a*, and the ratio (i.e., r2/t) of the radius of curvature r2 of the back-side curved surface 2*f* to the thickness t of the leading edge portion 2*a* are 1/2, and the front-side curved surface 2*e* is connected with the back-side curved surface 2*f*. As shown in FIG. 12, in a case where r1/t and r2/t are 1/2, and the front-side curved surface 2*e* is connected with the back-side curved surface 2*f*, the cross-section of the leading edge portion 2*a* has a complete circular arc. In this case, the leading edge portion 2*a* has the most rounded shape, so that the fibrous substance 30 can more smoothly slide on the leading edge portion 2*a* toward the outer end 2*d*. Therefore, r1/t is preferably equal to or less than 1/2.

As shown in FIG. 7, FIG. 8, and FIG. 9, the thickness t of the leading edge portion 2*a* gradually decreases according to the distance from the hub 13. In contrast, the radius of curvature r1 of the front-side curved surface 2*e* and the radius of curvature r2 of the back-side curved surface 2*f* are constant from the inner end 2*c* to the outer end 2*d* of the leading edge portion 2*a*. Therefore, r1/t and r2/t gradually increase according to the distance from the hub 13. With such configurations, the leading edge portion 2*a* can guide the fibrous substance 30 toward the inlet 18*a* (see FIG. 5) of the groove 18 while suppressing the decrease in the discharging performance of the volute pump.

Figure 13:
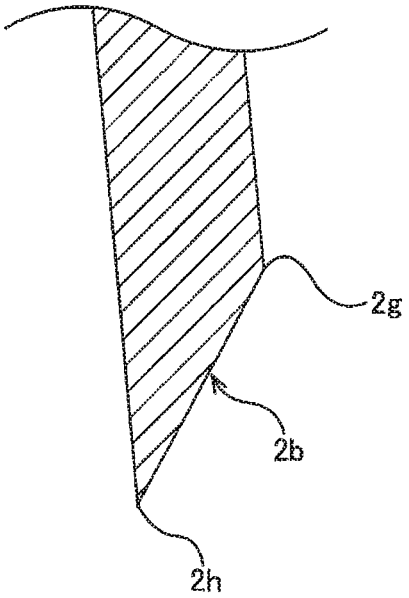
FIG. 13 is a cross-sectional view of a trailing edge portion of the sweep-back vane taken along line F-F in FIG. 6.
Figure 14:
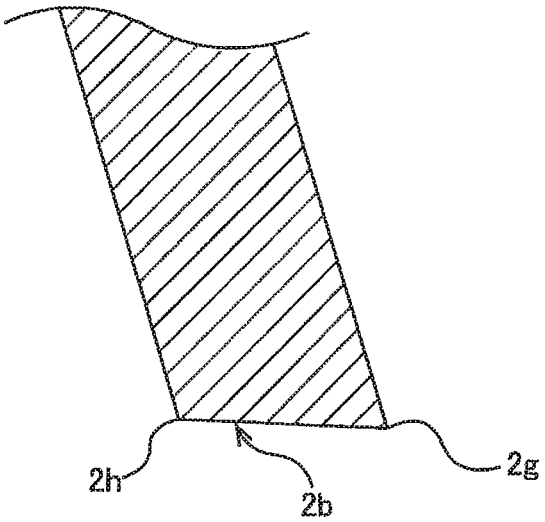
FIG. 14 is a cross-sectional view of the trailing edge portion of the sweep-back vane taken along line G-G in FIG. 6.
Figure 15:
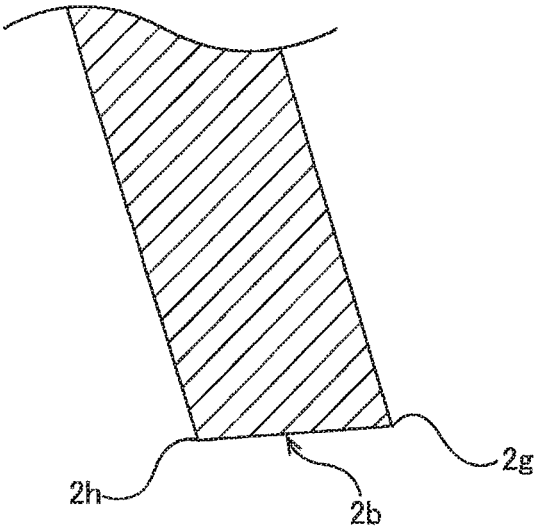
FIG. 15 is a cross-sectional view of the trailing edge portion of the sweep-back vane taken along line H-H in FIG. 6.

Next, a shape of the trailing edge portion 2*b* will be described with reference to FIG. 13, FIG. 14, and FIG. 15. FIG. 13 is a cross-sectional view of the trailing edge portion 2*b* of the sweep-back vane 2 taken along line F-F in FIG. 6. FIG. 14 is a cross-sectional view of the trailing edge portion 2*b* of the sweep-back vane 2 taken along line G-G in FIG. 6. FIG. 15 is a cross-sectional view of the trailing edge portion 2*b* of the sweep-back vane 2 taken along line H-H in FIG. 6.

As shown in FIG. 13, FIG. 14, and FIG. 15, the trailing edge portion 2*b* has a front-side angular portion 2*g* and a back-side angular portion 2*h*, each of which extends from a starting end to a terminal end 2*i* (see FIG. 6) of the trailing edge portion 2*b* connected to the outer end 2*d* of the leading edge portion 2*a*. The front-side angular portion 2*g* forms a forefront of the trailing edge portion 2*b* with respect to the rotating direction of the trailing edge portion 2*b* (i.e., the rotating direction of the impeller 1). The back-side angular portion 2*h* forms a rearmost side of the trailing edge portion 2*b* with respect to the rotating direction of the trailing edge portion 2*b* (i.e., the rotating direction of the impeller 1), and is located behind the front-side angular portion 2*g* in the rotating direction of the impeller 1. The front-side angular portion 2*g* and the back-side angular portion 2*h* extend from the starting end of the trailing edge portion 2*b*, which is connected to the outer end 2*d* of the leading edge portion 2*a*, to the terminal end 2*i* (see FIG. 6) of the trailing edge portion 2*b*. The front-side angular portion 2*g* and the back-side angular portion 2*h* are formed as an angular edge like a blade, as contrasted to the front-side curved surface 2*e* and the back-side curved surface 2*f* of the leading edge portion 2*a*.

Figure 16:
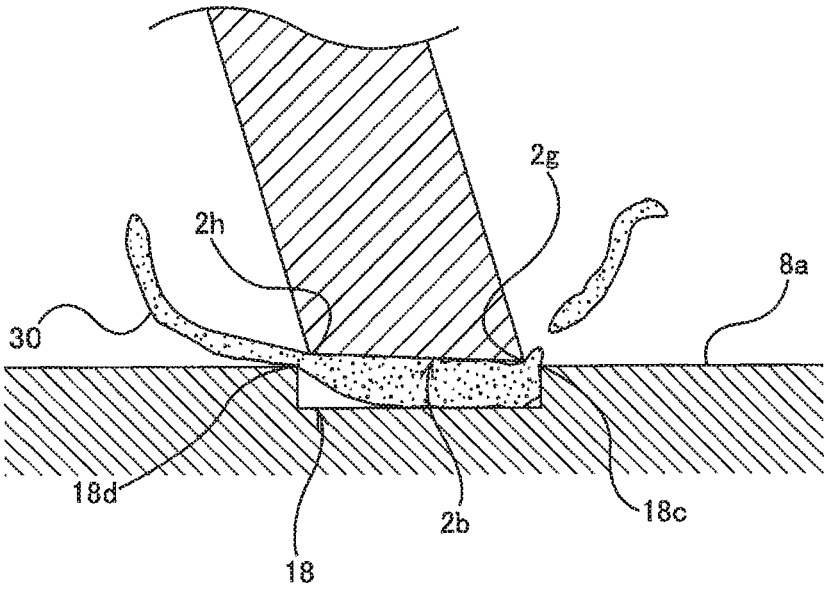
FIG. 16 is a cross-sectional view showing the trailing edge portion when moving across the groove.
Figure 17:
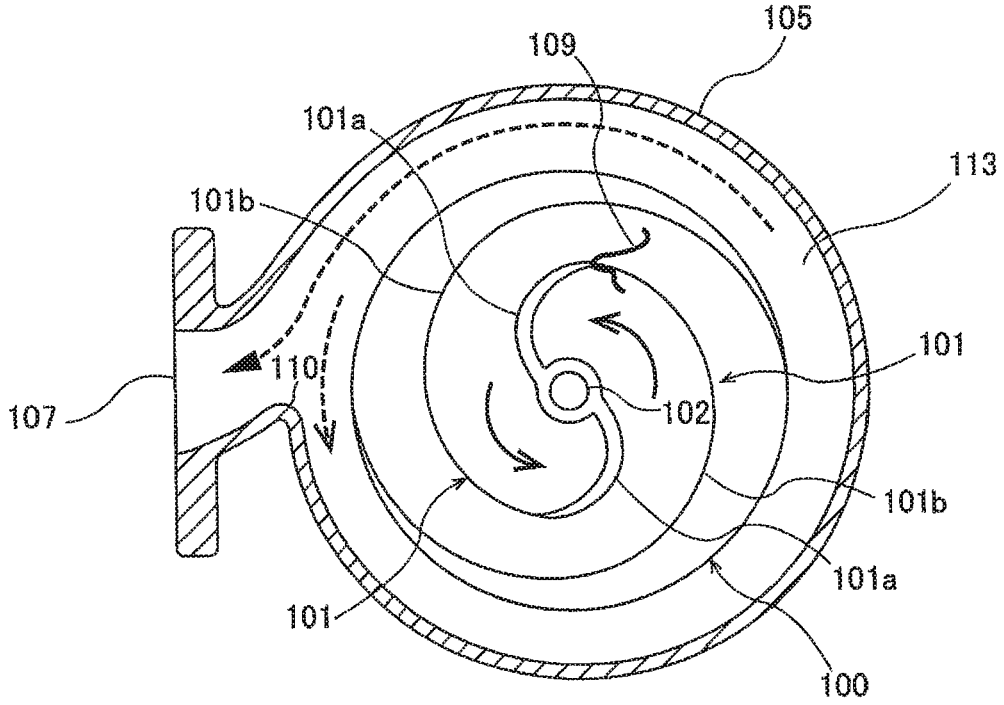
FIG. 17 is a cross-sectional view showing a volute pump which includes an impeller having sweep-back vanes.
Figure 18:
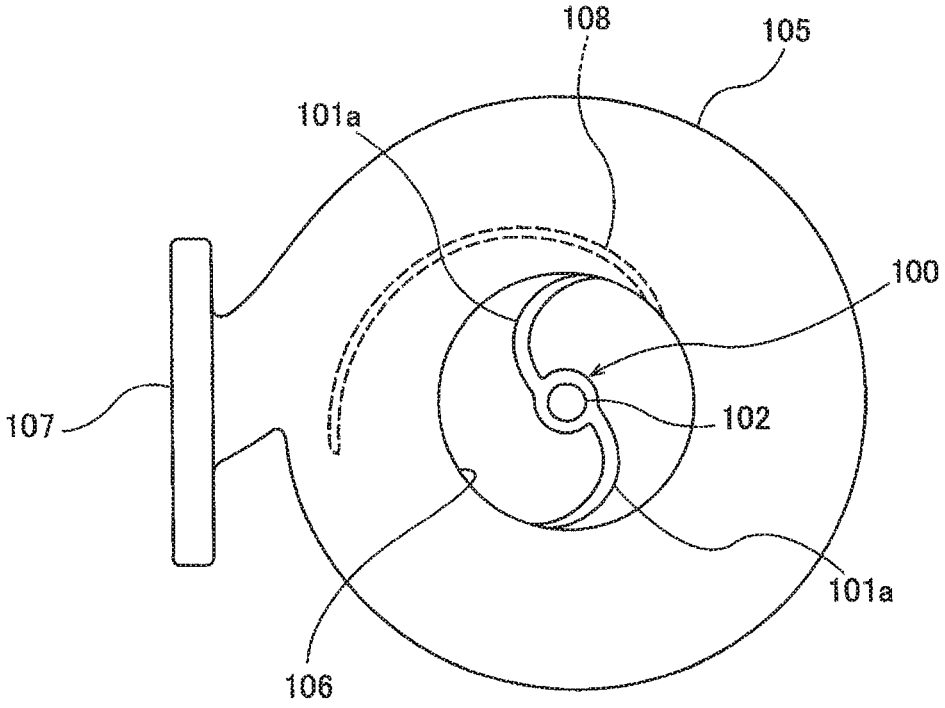
FIG. 18 is a view showing an impeller casing, which houses the impeller therein, as viewed from a suction-port-side.
Figure 19:
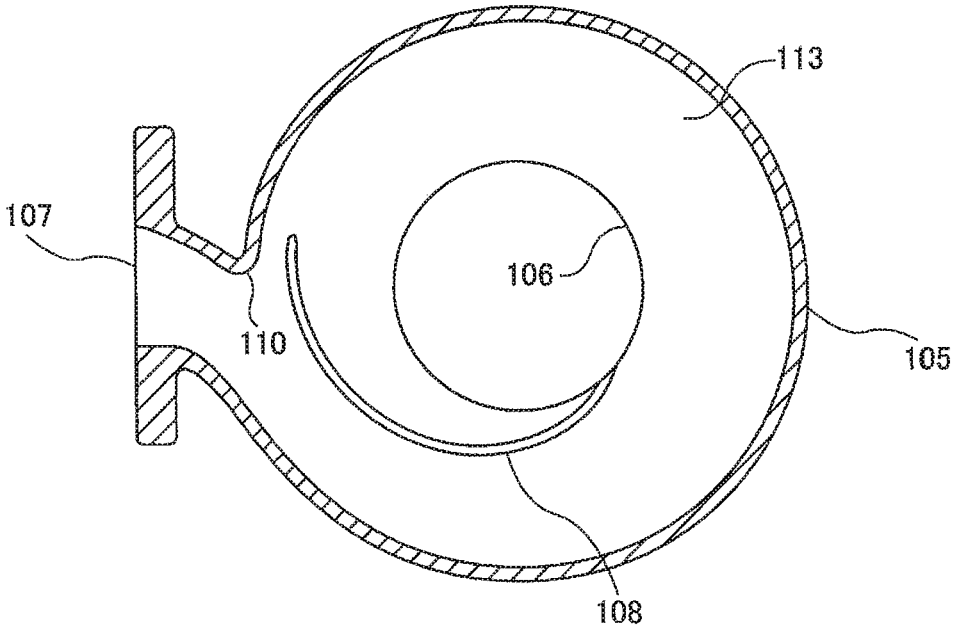
FIG. 19 is a view showing an inner surface of the impeller casing as viewed from an actuator-side.
Figure 20:
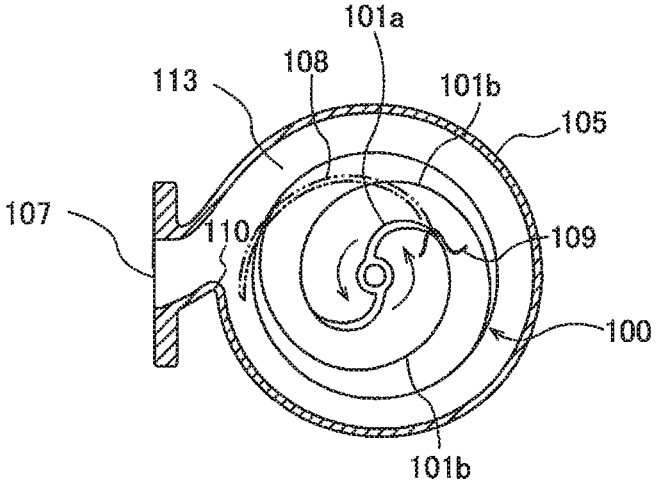
FIG. 20 is a view showing a state in which a fibrous substance is transferred to a volute chamber through a groove.
Figure 21:
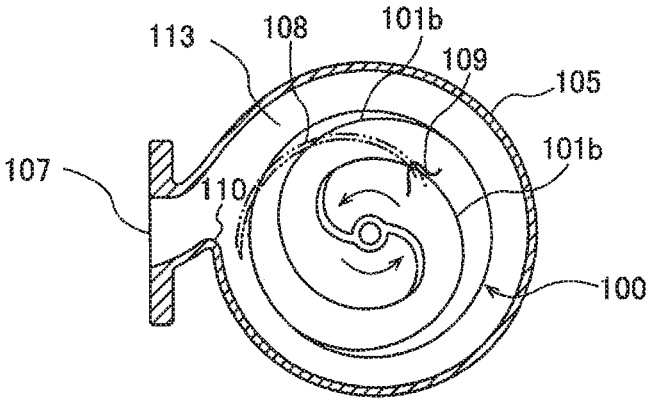
FIG. 21 is a view showing a state in which the fibrous substance is transferred to the volute chamber through the groove.
Figure 22:
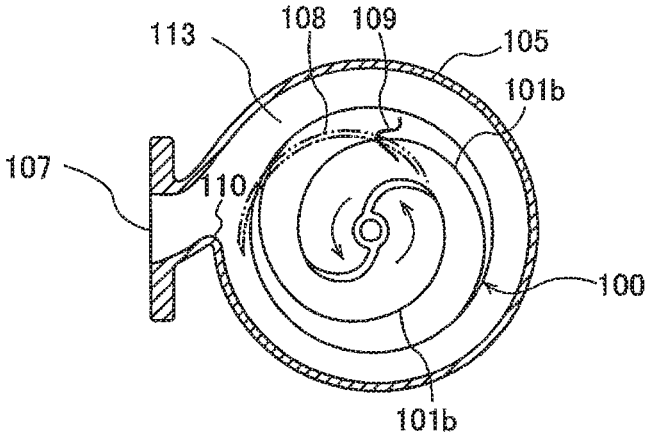
FIG. 22 is a view showing a state in which the fibrous substance is transferred to the volute chamber through the groove.
Figure 23:
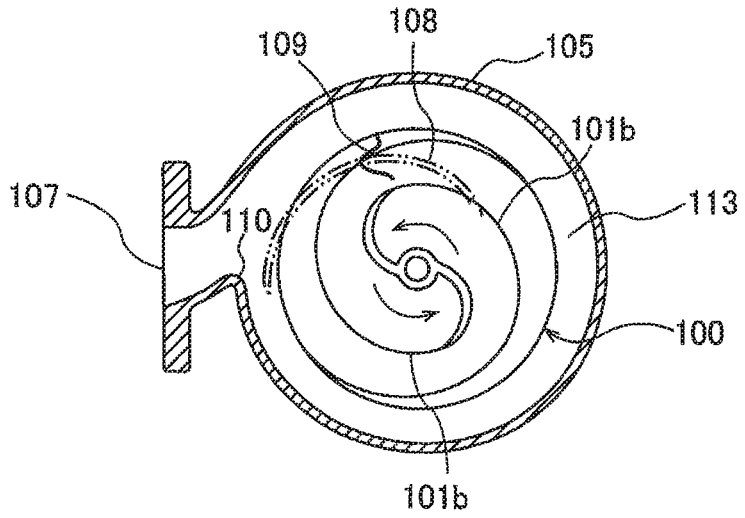
FIG. 23 is a view showing a state in which the fibrous substance is transferred to the volute chamber through the groove.
Figure 24:
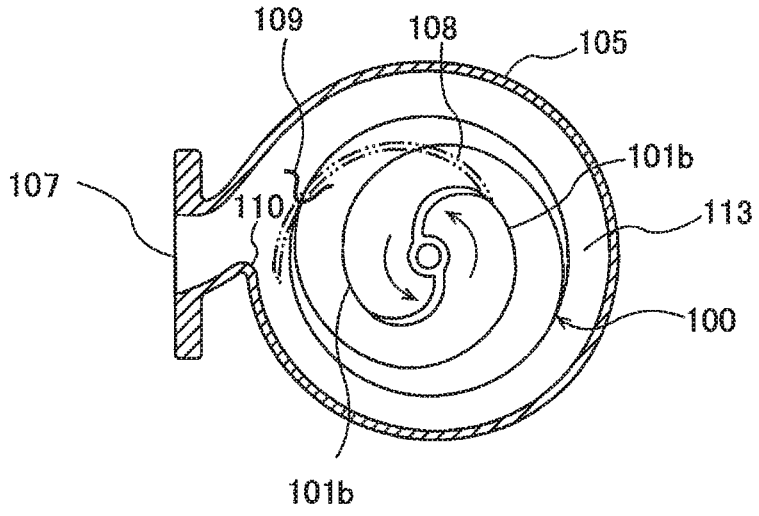
FIG. 24 is a view showing a state in which the fibrous substance is transferred to the volute chamber through the groove.

FIG. 16 is a cross-sectional view showing the trailing edge portion 2*b* when moving over the groove 18. As shown in FIG. 16, the fibrous substance 30, which has been pushed into the groove 18 by the front-side curved surface 2*e*, moves along the groove 18 while being caught by the front-side angular portion 2*g* and the back-side angular portion 2*h*. Therefore, the trailing edge portion 2*b* can easily transfer the fibrous substance 30 to the volute chamber 7. Further, as shown in FIG. 16, it is expected that the fibrous substance 30, when being transferred along the groove 18, is sandwiched and cut by the front-side and back-side angular portion 2*g*, 2*h* and angular portions 18*c*, 18*d* of the groove 18. The cut fibrous substances 30 are transferred to the volute chamber 7 together with the liquid delivered by the rotation of the impeller 1, and then discharged through the discharging port 4. As a result, it is possible to prevent the fibrous substance 30 from clogging the volute pump.

The impeller 1 of this embodiment is produced by, for example, casting. A metal block may be ground to thereby produce the impeller 1 of this embodiment. In a case where the impeller 1 is produced by casting, the impeller 1 may be produced by use of a mold in which concave surfaces are formed at parts corresponding to the front-side curved surface 2*e* and the back-side curved surface 2*f* of the leading edge portion 2*a*. Alternatively, a machining process, such as polishing process, or grinding process, may be performed on the impeller 1 after casting to thereby form the front-side curved surface 2*e* and the back-side curved surface 2*f*. In the case where the impeller 1 is produced by casting, in order to form each of the front-side angular portion 2*g* and the back-side angular portion 2*h* of the trailing edge portion 2*b* as the blade shaped angular portion, a machining process, such as polishing process, or grinding process, is preferably performed on the front-side angular portion 2*g* and the back-side angular portion 2*h*.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

INDUSTRIAL APPLICABILITY

The present invention is applicable to a volute pump for delivering a liquid containing fibrous substances.

REFERENCE SIGNS LIST

1 impeller
2 sweep-back vane
2*a* leading edge portion
2*b* trailing edge portion
2*c* inner end
2*d* outer end
2*e* front-side curved surface
2*f* back-side curved surface
2*g* front-side angular portion
2*h* back-side angular portion
2*i* terminal end
3 suction port
4 discharging port
5 casing
6 casing body
7 volute chamber
8 casing liner
8*a* inner surface
10 tongue portion
11 rotational shaft
12 shroud
13 hub
13*a* through-hole
18 groove
20 motor
21 mechanical seal
30 fibrous substance

The invention claimed is:

1. A volute pump comprising:

an impeller rotatable together with a rotational shaft; and an impeller casing having a suction port and a volute chamber;

wherein a groove, extending from the suction port to the volute chamber is formed in an inner surface of the impeller casing, wherein the impeller includes:

a hub to which the rotational shaft is fixed, and a sweep-back vane extending helically from the hub in a direction opposite to a rotating direction of the impeller, wherein the sweep-back vane includes:

a leading edge portion extending helically from the hub, and a trailing edge portion extending helically from the leading edge portion, wherein the leading edge portion has a front-side curved surface extending from an inner end of the leading edge portion to an outer end of the leading edge portion, a back-side curved surface extending from the inner end of the leading edge portion to the outer end of the leading edge portion, and a flat top surface connecting the front-side curved surface to the back-side curved surface, the front-side curved surface being a surface of the leading edge portion which is located at a foremost position in the rotating direction of the impeller and such that a cross-section of the front-side curved surface in a thickness direction of the sweep-back vane has an arc shape with a first radius of curvature, the back-side curved surface being a surface of the leading edge portion which is located at a rearmost position in the rotating direction of the impeller and such that a cross-section of the back-side curved surface in the thickness direction of the sweep-back vane has an arc shape with a second radius of curvature, wherein an inlet of the groove is an opening formed in the suction port, such that when the impeller is rotated, the outer end of the leading edge portion moves across the inlet of the groove.

2. The volute pump according to claim 1, wherein a ratio of the first radius of curvature of the front-side curved surface to a thickness of the leading edge portion is in a range of 1/7 to 1/2.

3. The volute pump according to claim 2, wherein the ratio of the first radius of curvature of the front-side curved surface to the thickness of the leading edge portion is in a range of 1/4 to 1/2.

4. The volute pump according to claim 2, wherein the ratio of the first radius of curvature of the front-side curved surface to the thickness of the leading edge portion gradually increases according to a distance from the hub.

5. The volute pump according to claim 1, wherein the trailing edge has a front-side angular portion and a back-side angular portion extending from a starting end of the trailing edge portion to a terminal end of the trailing edge portion, the front-side angular portion being a forefront of the trailing edge portion with respect to the rotating direction of the impeller, and the back-side angular portion being a rearmost side of the trailing edge portion with respect to the rotating direction of the impeller.

* * * * *